US005320451A

United States Patent [19]

Garvey et al.

[11] Patent Number: 5,320,451

[45] Date of Patent: Jun. 14, 1994

[54] CABLE LAYING ATTACHMENT FOR TILLER

[76] Inventors: John R. Garvey, 1450 W. Ann Arbor Rd., #11, Plymouth, Mich. 48170; Robert J. DeCelle, Jr., 4688 Kenicott Trail, Brighton, Mich. 48116; James C. Veale, 13300 Spencer Rd., Milford, Mich. 48380

[21] Appl. No.: 33,833

[22] Filed: Mar. 19, 1993

[51] Int. Cl.[5] ..... F16L 1/00

[52] U.S. Cl. ..... 405/181; 405/174; 405/180

[58] Field of Search ..... 405/174–183; 172/40, 699; 37/94

[56] References Cited

U.S. PATENT DOCUMENTS

| | | | |
|---|---|---|---|
| 781,568 | 1/1905 | Stevens . | |
| 3,066,491 | 12/1962 | Ryan . | |
| 3,201,944 | 8/1965 | Christensen . | |
| 4,285,613 | 8/1981 | Takagishi et al. | 405/174 X |
| 4,326,347 | 4/1982 | Ballinger | 405/180 X |
| 4,537,531 | 8/1985 | Diefenthaler | 405/174 |
| 4,685,832 | 8/1987 | Decker | 405/184 |
| 4,812,078 | 3/1989 | Rivard | 405/174 X |
| 4,914,840 | 4/1990 | Porter | 405/174 X |
| 5,174,686 | 12/1992 | Raymond | 405/184 |
| 5,214,868 | 1/1993 | Persbacker | 405/174 X |

FOREIGN PATENT DOCUMENTS

| | | | |
|---|---|---|---|
| 2548 | 3/1890 | Sweden | 405/174 |

*Primary Examiner*—Dennis L. Taylor

*Attorney, Agent, or Firm*—Reising, Ethington, Barnard, Perry & Milton

[57] ABSTRACT

A cable laying attachment for an engine driven tiller has a cutter wheel with a plurality of countersunk carbide tips in the teeth of the cutter wheel; the cutter wheel being connected to a tine drive shaft connected to a transmission for transferring power from the engine for automatically cutting a trench to a desired depth as the tiller is driven forwardly by a pair of engine driven wheels and a trailing arm and feed tube are connected to a protective cowl on the transmission housing that guards the cutter wheel; the trailing arm and feed tube receiving and placing wire from a spool into the trench; the trailing arm serves to displace the cut trench material while positioning the outlet end of the feed tube so as to locate a wire or cable at the bottom of the trench formed by the cutter wheel.

10 Claims, 2 Drawing Sheets

CABLE LAYING ATTACHMENT FOR TILLER

FIELD OF THE INVENTION

This invention relates to cable layers and more particularly to cable layers having a feed tube for distributing wire or cable into the ground.

BACKGROUND OF THE INVENTION

Present day cable or wire layers include engine driven machines that have an oscillating blade that penetrates the ground to a predetermined depth while the machine is driven forward to feed the wire or cable into the ground. Examples of such machines are those shown in U.S. Pat. Nos. 3,201,944 and 4,685,832.

Other wire and cable laying devices are known in which a plow is drawn or forced through the ground to open a trench into which a cable or wire is laid. An example of such a device is shown in U.S. Pat. No. 3,066,491 and in U.S. Pat. No. 781,568.

U.S. Pat. No. 5,174,686 discloses a pipe laying machine having a cutter wheel that digs a trench. A blade mounted water jet is provided to form path within a slit formed by the cutter into which a length of pipe is placed.

The engine driven machines of the '944 and '832 patents that include a vibrating arm are better adapted to soil conditions that do not have obstructions in the path of the machine. If such obstructions or other impediments such as roots are present the machine may have to be removed from the trench and the obstruction removed to clear a path for the oscillating blade to form the path for laying the cable.

The manually operated devices shown in the '491 and '568 patents require two separate trenching components. The first component is a small diameter wheel that forms a shallow depression in the ground surface. The shallow depression is then opened up by a plow member that forms a furrow defining a trench. As in the case of the engine driven machines, such devices are difficult to use in soil conditions that include obstructions such as roots or debris.

The special pipe laying machine shown in the '686 patent does not disclose or suggest a cable laying attachment system for use with engine powered tillers that include a carbide tipped saw blade for forming a full depth trench and that will cut through obstructions so as to obviate the need for removing and repositioning a cable laying implement to clear the obstruction.

SUMMARY OF THE INVENTION

The present invention includes a tiller attachment system for pulling and laying a cable as the tiller is driven forwardly. The attachment system includes a carbide toothed cutter wheel that has a diameter that will cut a completed trench through a wide variety of soil conditions including obstructions buried in such all types of soil without removing the tiller from the trench. The cutter wheel is associated with a trailing arm that displaces the cut trench material while positioning the outlet end of a feed tube so as to locate a wire or cable at the bottom of the trench formed by the cutter wheel.

An object of the present invention is to provide an engine driven tiller attachment that will form a trench in a variety of soil types while cutting through obstacles to avoid removing the tiller from the trench while providing for cutting a trench while displacing trenched material and laying a cable or wire at the bottom of the trench without removing the tiller from the trench during the trenching and cable/wire laying operation.

A feature of the present invention is to provide for such a tiller attachment system including a cutter wheel having carbide tipped teeth capable of cutting through obstructions in the path of a trench formed by the tiller attachment system and wherein the cutter wheel has a hub adapted to be connected to a tine drive shaft of an engine driven tiller for supporting the cutter wheel within a protective cowl at one side thereof, the cutter wheel having a diameter for providing a variable depth trench to a maximum depth in the range of from six to eight inches in depth and the tiller attachment system further including a height adjustment bar adapted to be connected to the protective cowl for adjusting the position of a ground engaging component for adjusting the depth of the trench to be cut by the cutter wheel; the attachment system also including a fixed depth trailing arm adapted to be connected to the protective cowl rearwardly of the cutter wheel in line therewith whereby the trailing arm will be pulled through a trench formed by the cutter wheel; the attachment system additionally including a feed tube having an inlet and an outlet connected to the fixed depth trailing arm; the feed tube outlet being curved rearwardly of the fixed depth trailing arm to place wire or cable fed therefrom at the bottom of a trench formed by the cutter wheel as the tiller is driven forwardly by a pair of engine driven drive wheels connected to a transmission housing of the tiller.

A further feature of the present invention is to provide such a tiller attachment system having a cowl plate adapted to be mounted on the protective cowl at the rear end thereof; a bracket on one end of the cowl plate adapted to be connected to the fixed depth trailing arm for mounting the trailing arm fixedly on the protective cowl.

Another feature of the present invention is to provide such a tiller attachment system further comprising a cutter wheel for forming a trench width through which a sharpened leading edge of the fixed depth trailing arm will pass without restriction and the fixed depth trailing arm thereby forming a groove within the trenched material into which the wire or cable can be layed.

Still another feature of the present invention is to provide a tiller attachment system further comprising a cowl plate connected to the protective cowl at the rear end thereof, first and second brackets connected to the cowl plate; one of the first and second brackets adapted to hold a spool of wire or cable; the other of the first and second brackets adapted to secure the fixed depth positioning arm at a position with respect to the protective cowl wherein the cable or wire is always positioned by the feed tube within the bottom of the trench formed by the cutter wheel.

Still another object is to provide a cowl plate having a single bracket thereon that serves to mount both the fixed depth positioning arm and a spool of wire that is fed from the spool through the feed tube and wherein the single bracket includes a plurality of spaced openings therein for receiving the axle of a variety of spools having different diameters.

Another feature of the present invention is to provide a tiller attachment system as set forth in the preceding features and objects further comprising a feed tube having three offset sections therein; one of the offset sections being inclined forwardly of the protective cowl at the rear end thereof and another of the offset section being inclined downwardly in a direction facing away from the protective cowl whereby a cable or wire can be fed from a point above the protective cowl into the inlet end of the feed tube and can be distributed from the outlet end of the feed tube directly into a trench formed by the cutter wheel at the bottom thereof as the tiller is driven forwardly.

Yet another feature of the present invention is to provide a tiller attachment system as set-forth in any of the preceding objects and features wherein the depth of the cut by the cutter wheel is established by a ground engaging component that is adjustably positioned at different distances with respect to the protective cowl by an adjusting arm.

Still another feature is to provide the cutter depth control of the preceding feature wherein the ground engaging component is a skid connected to the adjusting arm by a parallelogram linkage.

Still another feature is to provide the cutter control by a ground engaging component is a wheel connected to the end of a bend arm segment that trails the protective cowl.

BRIEF DESCRIPTION OF THE DRAWINGS

Other advantages of the present invention will be readily appreciated as the same become better understood by reference to the following detailed description when considered in connection with the accompanying drawings wherein.

DESCRIPTION OF PREFERRED EMBODIMENTS OF THE INVENTION

Figure 1:
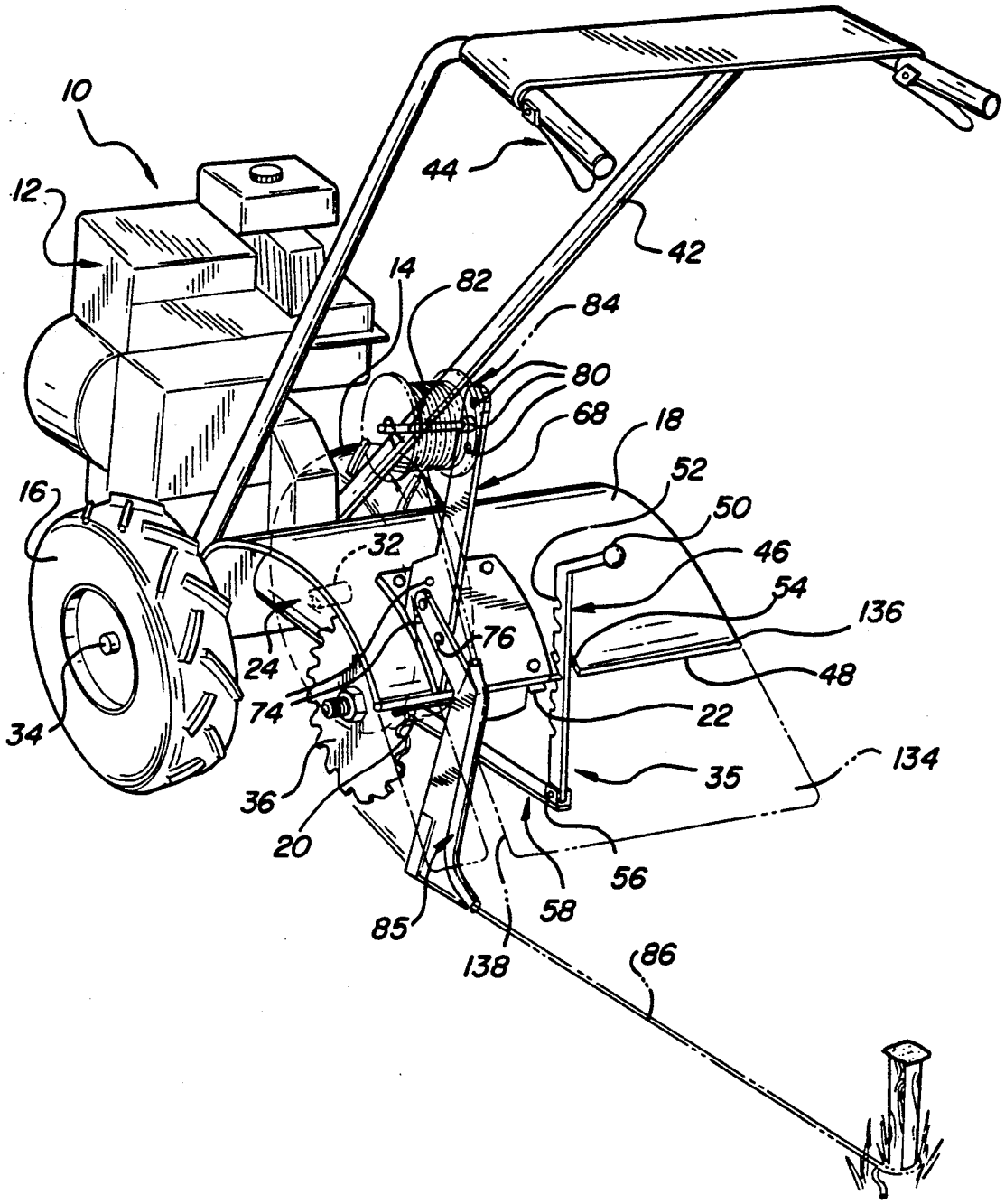
FIG. 1 is a perspective view of an engine driven tiller including the present invention.

Referring now to FIG. 1 a tiller 10 is illustrated having a driven engine 12 for driving a pair of forwardly located drive wheels 14, 16. The tiller 10 further includes a protective cowl 18 that is adapted to cover known tines (not shown). The tines are mounted on oppositely directed tine drive shafts 20, 22 that are driven by internal gearing of a transmission 24. The transmission includes an input shaft 26 that is connected to a step pulley 28 for transferring power from the power take off 30 of the engine 12 to the transmission 24. The transmission further includes a pair of drive shafts 32, 34 that are connected respectively to the drive wheels 14, 16.

The transmission 24 shown in FIG. 1 is that used in the 7HP Standard Horse Model manufactured and sold Garden Way Inc. and described in its 1993 catalogue under its registered trademark TROY-BUILT.

The illustrated drive and transmission are merely representative of a suitable drive for use in a tiller with it being understood that the present invention is equally suitable for use with other power driven tillers so long as they include a drive engine and a transmission operative to distribute power to both drive wheels and to a drive shaft adapted to drive the tines of the tiller.

In the FIG. 1 embodiment of the invention, a cable laying attachment system 35 is associated with the tiller 10. The attachment system includes a cutter wheel 36 is connected to the tine drive shaft 20. The cutter wheel 36 is covered by the protective cowl 18 that is secured to a member 38 fixed to the transmission by a brace 40. A handle 42 is also provided for guiding the tiller 10. Suitable controls 44 are mounted on the handle for controlling the speed of drive through the drive wheels 14, 16 and for controlling when the cutter wheel 36 is actuated through a sliding dog tine clutch 45 that is accessible on one side of the transmission 24. The depth of the cut of the cutter wheel 36 is established by a height adjustment bar 46 located at the rear end 48 of the protective coil 38. The adjustment bar 46 has an offset handle 50 for changing the position of the adjustment bar 46 by indexing spaced side notches 52 therein with respect to a locking ledge 54 on the rear end 48. The adjustment bar 46 has a lower end thereof connected by a pivot pin 56 to one end of a skid plate 58. The skid plate 58 curves downwardly to form a ground engaging surface 60 representing a reference component that will establish the depth to which the cutter wheel 36 can penetrate into the surface of the ground. A forward end 64 of the skid plate 58 is connected by a pivot pin 62 to the front edge 65 of the protective cowl 18 on the underside thereof. The ground engaging surface 60 can thereby be positioned closer or further from the protective cowl 18 depending upon which notch 52 is selected in the adjustment bar to be interlocked to the ledge 54.

Figure 2:
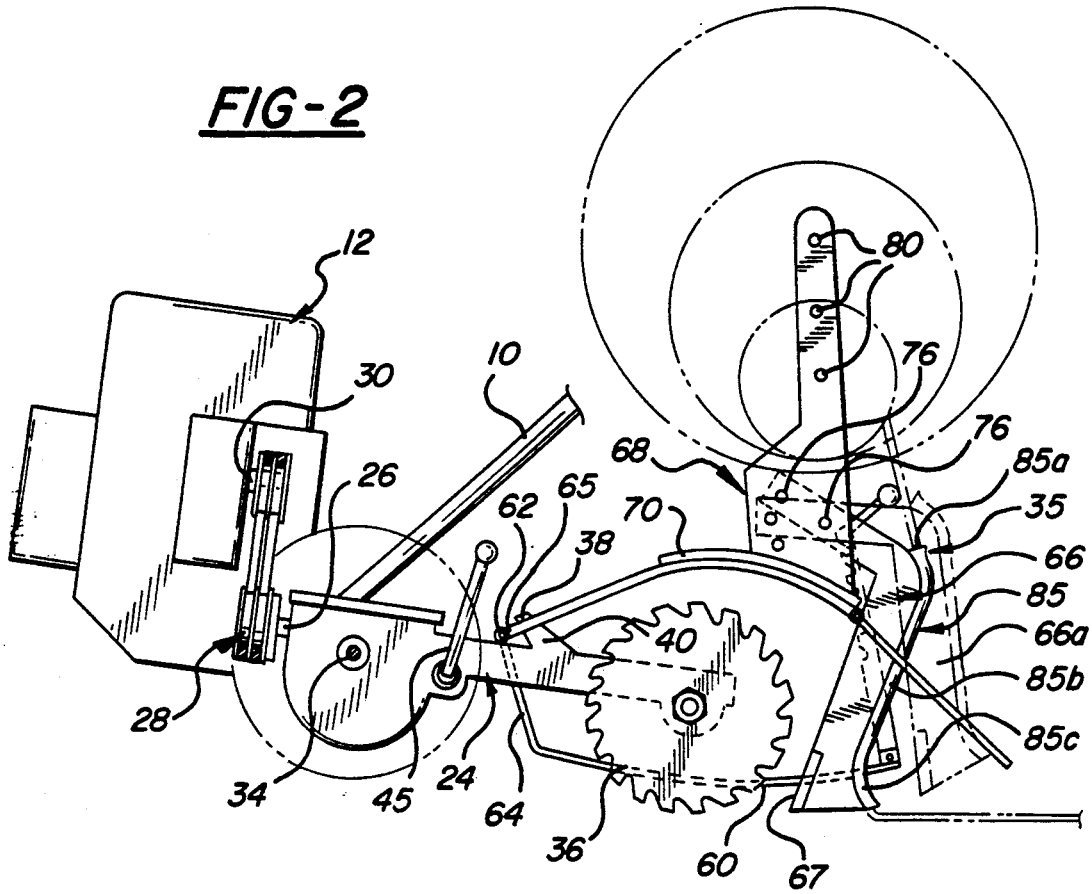
FIG. 2 is a side elevational view of the engine driven tiller of FIG. 1.

Additionally, the cable laying attachment system 35 includes a fixed depth trailing arm 66 having a sharpened leading edge 67 that is located in line and behind the cutter wheel 36. As shown in FIG. 2, the trailing arm 66 can be adjustably inclined with respect to the cutter wheel 36. In the solid line position, the trailing arm 66 is inclined forwardly toward the cutter wheel 36. It has been found that this position is best for clay type soil conditions that tend to displace the arm 66 upwardly from the trench. The forward inclination position holds the trailing arm 66 downwardly in the trench so that a cable feed tube 85, described hereinafter, will properly place the cable or wire in the bottom of the trench formed by the cutter wheel 36. In the broken line position, shown at 66*a* in FIG. 3, the trailing arm is tilted more rearwardly. This adjusted position is more suited for sandy soil conditions. The trailing arm 66 is connected to a bracket 68 formed on a cowl plate 70 that fits over the upper surface of the protective cowl 18 above the rear thereof. The cowl plate 70 is connected to the cowl 18 by a plurality of screws 72. The bracket 68 has holes 74 through which bolts 76 are directed to secure the trailing arm 66 in a generally vertical position. The bracket 68 has an upwardly directed arm 78 thereon with three spaced holes 80 therethrough. The holes 80 are arranged to support the axle 82 of different diameter wire spools, one of which is shown in FIG. 1 at 84. A smaller diameter spool can be supported on the hole below the illustrated middle hole mount. A larger diameter spool can be supported on the hole above the illustrated middle hole mount.

The wire from the spool is directed through a feed tube 85 supported on the trailing edge of the fixed depth trailing arm 66. The feed tube 85 has three offset sections 85*a*, 85*b* and 85*c*. The offset section 85*a* is inclined forwardly of the protective cowl 18 at the rear end thereof. An intermediate offset section 85*b* is inclined downwardly in a direction facing away from the protective cowl whereby a cable or wire can be fed from a point above the protective cowl into the inlet end of the feed tube and can be distributed from a rearwardly offset outlet end 85c of the feed tub 85 directly into a trench formed by the cutter wheel 36 at the bottom thereof as the tiller is driven forwardly. As pointed out above, the angle of inclination of the fixed depth trailing arm best suited for laying a wire or cable at the bottom of the preformed trench will depend on the type of soil being trenched.

In operation, the attachment system 35 of the present invention includes engaging the drive to the carbide toothed cutter wheel 36 that has a diameter that will cut a completed trench through a wide variety of soil conditions including buried obstructions without removing the tiller from the trench. The transmission 24 is controlled in a known manner to transfer power to the drive wheels 14, 16 thus pulling the trailing arm 66 behind the cutter wheel 36 through the trench formed by the cutter wheel. The trailing arm 66 displaces the cut trench material at the sharpened leading edge 67. At the same time a wire lead 86 is extended from the outlet 85c and is fixedly located at the bottom of the trench formed by the cutter wheel. Continual drive by the wheels 14, 16 will cause the cutter wheel 36 to form a trench that can have any pattern established by the direction in which the tiller 10 is steered by the handle 42. At the same time the wire is laid into the bottom of the trench at which the outlet 85c is positioned due to the pulling action of the wheels 14, 16.

The cutter wheel 36 will form a trench in a variety of soil types while cutting through obstructions to form a trench without removing the tiller from the trench to remove the obstruction. At the same time the trailing arm 66 spreads any material remaining in the bottom of the trench and positions the outlet 85c of the feed tube 85 such that cable from the spool will be fed from the spool and pulled through the feed tube 85 to be laid at the bottom of the trench without removing the tiller from the trench during the trenching and cable/wire laying operation.

The cutter wheel has a diameter for providing a variable depth trench to a maximum depth in the range of from six to eight inches in depth and further is variably positioned by the height adjustment bar 46 for adjusting the position of a ground engaging component represented in the embodiment of FIG. 1 for adjusting the depth of the trench to be cut by the cutter wheel.

The illustrated attachment system 35 is easily adapted to existing tillers and will convert the tillers into a direct wire or cable laying machine that will automatically lay wire along a path that is established merely by the direction which the drive wheels are faced by the handle 42. The attachment is especially suitable for use in laying the wire component of hidden wire containment systems for animals. The automatic laying of wire is also suited for use in laying cable TV cable and other wiring systems including telephone wires and the like.

Figure 3:
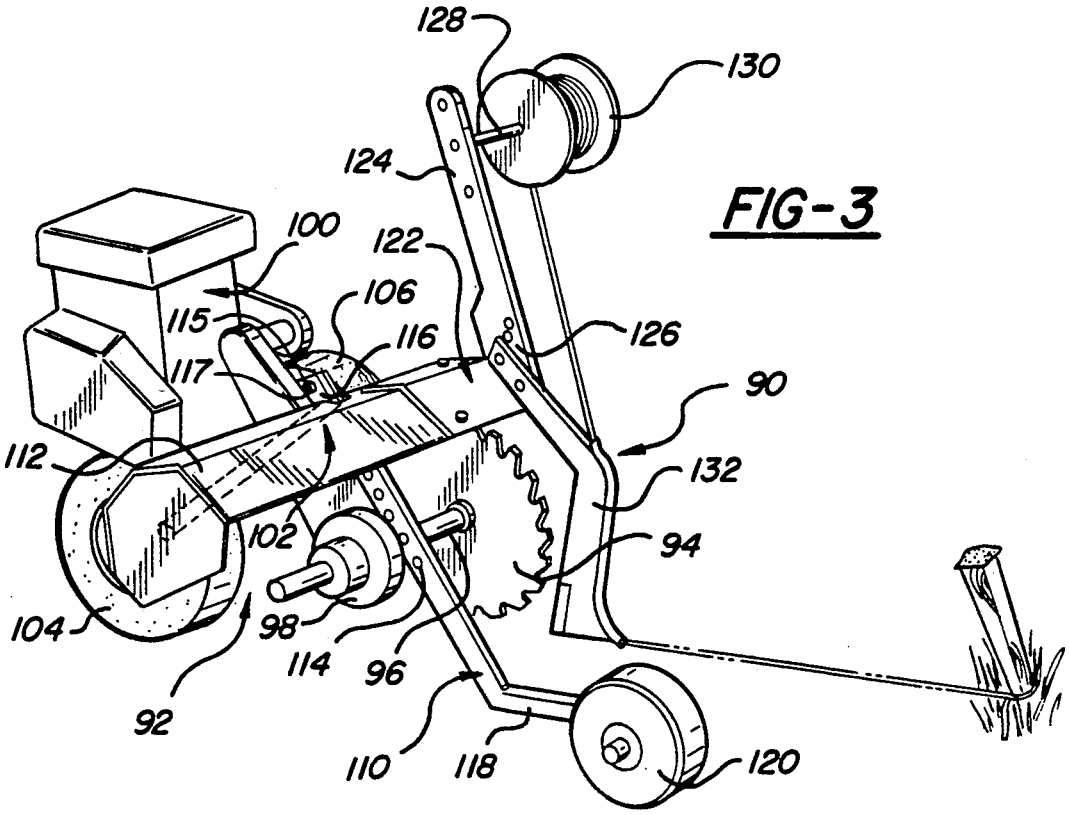
FIG. 3 is a perspective view of another engine driven tiller including another embodiment of the present invention.

The embodiment of the invention shown in FIG. 3 shows a tiller attachment system 90 that is associated with a Honda Model No. FP-800 tiller 92. In this embodiment the system 90 includes a carbide tipped cutter wheel 94 that is connected to a tine drive shaft 96 on a transmission 98. The tiller 92 has an engine 100 that is connected to the transmission 98. Drive shafts 102 from the transmission are connected to drive wheels 104, 106 located forwardly of the tiller 92 to pull it forwardly. The tiller 92 has a handle with suitable controls (not shown) for engaging the drive for the wheels 104, 106 and to drive the tine drive shaft 96 as in the case of the embodiment of FIGS. 1-2 described herein. The carbide tipped cutter wheel 94 has its cutting depth established by a height adjustment arm 110 located on the trailing edge of a protective cowl 112 for the cutter wheel 94. The height adjustment arm 110 has a plurality of spaced position holes 114 therein that are selectively aligned with a hole 115 on a bracket 116 that connects to the upper surface of the protective cowl 112. A pin 117 is directed through a selected hole in the arm 110 and the hole 115 in the bracket to establish the amount of the adjustment arm 110 that will depend downwardly from the protective cowl 112. The arm includes a rearwardly directed segment 118 that carries a ground engaging component in the form of a wheel 120. The distance between the wheel 120 and the protective cowl 112 will determine the depth of cut made by the teeth of the cutter wheel 94.

In this embodiment, a cowl plate 122 is attached to the upper surface of the protective coil 112 by screws. The cowl plate carries first and second brackets 124, 126 connected thereto. The first bracket 124 supports the axle 128 of a spool 130 of wire or cable. The second bracket 126 is secured to a fixed depth positioning arm 132 at a position with respect to the protective cowl wherein the cable or wire is always positioned by the feed tube within the bottom of the trench formed by the cutter wheel.

A trailing flap 134 can be connected to either the protective coil in either the embodiment of FIG. 1 or FIG. 3 by a hinge 136 that allows the trailing flap accommodate for different depth cuts. The flap 134 has a cutout 138 formed therein that surrounds the side surfaces of the cable positioning arm.

The operation of the embodiment shown in FIG. 3 is essentially the same as that described in the first embodiment. Specifically, the drive of the tiller 92 is positioned to engage the drive wheels 104, 106 and the tine drive shaft is coupled to the engine to drive the cutter wheel 94. The wire from the spool is directed through the feed tube and placed in the bottom of the trench formed by the cutter wheel. Continued forward drive of the tiller 92 will pull the wire from the pull and locate it in the bottom of the trench. The carbide tips on the cutter wheel 94 will cut through obstructions to enable the tiller to continually move forward while simultaneously forming a full depth trench and laying wire from the spool into the bottom of the trench.

The tiller attachment systems of the preceding embodiments enable known tillers to be modified at minimum cost and in a manner to provide a low cost engine driven trencher and cable layer machine with little or no modification to the existing drive and control components of the tiller. The resultant construction as described herein enables wires or cables to be easily laid within the trench to form hidden fence barriers for animals; to form paths for telephone or television cables or wires with little or no disturbing of the ground in which the cable or wire is laid.

The invention has been described in an illustrative manner, and it is to be understood that the terminology which has been used is intended to be in the nature of words of description rather than of limitation.

Obviously, many modifications and variations of the present invention in light of the above teachings may be made. It is therefore, to be understood that within the scope of the appended claims, the invention may be practiced otherwise than as specifically described.

What is claimed is:

1. A tiller attachment cable layer system for pulling and laying a wire or a cable from a tiller having a drive motor, a pair of forwardly located drive wheels selectively connected to the drive motor for pulling the tiller, a drive shaft adapted to be connected to tines and a protective cowl comprising:

a cutter wheel having a plurality of carbide tipped teeth thereon and a hub adapted to be connected to the tine drive shaft for supporting said cutter wheel within the protective cowl at one side thereof, said cutter wheel having a diameter for providing a variable depth trench;

a height adjustment bar adapted to be connected to the protective cowl and a ground engaging component connected to said height adjustment bar for adjusting the position of the ground engaging component with respect to the protective cowl to control the amount of cut made by said cutter wheel so as to adjust the depth of the trench to be cut by said cutter wheel;

a fixed depth trailing arm adapted to be connected to the protective cowl rearwardly of said cutter wheel in line therewith whereby said trailing arm will be pulled through a trench formed by said cutter wheel as the tiller is driven in a forward direction by the drive wheels;

and a feed tube connected to said fixed depth trailing arm having an inlet and an outlet; said feed tube outlet curved rearwardly of said fixed depth trailing arm to place wire or cable fed therefrom at the bottom of a trench formed by the cutter wheel as the tiller is driven forwardly by the drive system of the tiller.

2. The tiller attachment cable layer for pulling and laying a wire or a cable from a tiller of claim 1 further comprising said fixed trailing arm being adjustably positionable between forwardly and rearwardly inclined locations.

3. The tiller attachment cable layer for pulling and laying a wire or a cable from a tiller of claim 1 further comprising a cowl plate adapted to be mounted on said protective cowl at said rear end thereof; a bracket on one end of said cowl plate adapted to be connected to said fixed depth trailing arm for mounting said trailing arm fixedly on said cowl plate.

4. The tiller attachment cable layer for pulling and laying a wire or a cable from a tiller of claim 1 further comprising a cutter wheel having carbide tips countersunk in the periphery thereof.

5. The tiller attachment cable layer for pulling and laying a wire or a cable from a tiller of claim 1 further comprising a cowl plate connected to the protective cowl at the rear end thereof, first and second brackets connected to said cowl plate; one of said first and second brackets adapted to hold a spool of wire or cable; the other of said first and second brackets adapted to secure said fixed depth positioning arm at a position with respect to said protective cowl wherein the cable or wire is always positioned by said feed tube within the bottom of the trench formed by said cutter wheel.

6. The tiller attachment cable layer for pulling and laying a wire or a cable from a tiller of claim 1 further comprising a feed tube having three offset sections therein; one of said offset sections being inclined forwardly of said protective cowl at said rear end thereof and another of said offset section being inclined downwardly in a direction facing away from said protective cowl whereby a cable or wire can be fed from a point above the protective cowl into the inlet end of said feed tube and can be distributed from the outlet end of said feed tube directly into a trench formed by said cutter at the bottom thereof as the tiller is driven forwardly.

7. The tiller attachment cable layer for pulling and laying a wire or a cable from a tiller of claim 1 further comprising a single bracket thereon that serves to mount both the fixed depth positioning arm and a spool of wire from which wire is fed from the spool through the feed tube and wherein said single bracket includes a plurality of spaced openings therein for receiving the axle of a variety of spools having different diameters.

8. The tiller attachment cable layer for pulling and laying a wire or a cable from a tiller of claim 1 further comprising a ground engaging component that is adjustably positioned at different distances with respect to the protective cowl by said adjusting arm so as to vary the depth of the cut of the cutter wheel.

9. The tiller attachment cable layer for pulling and laying a wire or a cable from a tiller of claim 7 further comprising said ground engaging component comprising a skid and a parallelogram linkage connected to the adjusting arm for varying the angles of said parallelogram linkage to control the vertical position of said skid with respect to said protective cowl.

10. The tiller attachment cable layer for pulling and laying a wire or a cable from a tiller of claim 7 further comprising said ground engaging component comprising a wheel and a bent arm segment that trails the protective cowl connected to said wheel to control the vertical position of said wheel with respect to said protective cowl.

* * * * *